US007041016B1

(12) United States Patent
Omtvedt

(10) Patent No.: US 7,041,016 B1
(45) Date of Patent: May 9, 2006

(54) VOLLEYBALL SPIKING TRAINING SYSTEM

(76) Inventor: David Omtvedt, 402 Cherry Ave., Madison Lake, MN (US) 56063

( * ) Notice: Subject to any disclaimer, the term of this patent is extended or adjusted under 35 U.S.C. 154(b) by 0 days.

(21) Appl. No.: 10/919,976

(22) Filed: Aug. 17, 2004

(51) Int. Cl.
*A63B 69/00* (2006.01)

(52) U.S. Cl. ..... 473/426; 473/459; 473/473; 473/422; 473/423

(58) Field of Classification Search ..... 473/459, 473/473, 422, 423, 426, 430

See application file for complete search history.

(56) References Cited

U.S. PATENT DOCUMENTS

| | | | | |
|---|---|---|---|---|
| 861,506 | A * | 7/1907 | Doyle | 473/426 |
| 4,372,561 | A * | 2/1983 | Morgan et al. | 473/426 |
| 4,881,742 | A * | 11/1989 | Hargreave | 473/575 |
| 4,948,150 | A * | 8/1990 | Daly et al. | 473/430 |
| 5,060,946 | A * | 10/1991 | Taylor | 473/429 |
| 5,873,798 | A * | 2/1999 | Bostick | 473/426 |
| 5,957,781 | A * | 9/1999 | Kelly | 473/140 |
| 2005/0037874 | A1* | 2/2005 | McCoy | 473/430 |

OTHER PUBLICATIONS

Printout of Web Page VolleyHut.com, for Spike it Apparatus, Printout date of Aug. 2, 2004.
Printout of Web Page VolleyHut.com, for Crush it Apparatus, Printout date of Aug. 2, 2004.
Printout of Web Page KBAcoach.com, for Spike Master Apparatus, Printout date Aug. 2, 2004.

* cited by examiner

*Primary Examiner*—Raleigh W. Chiu
(74) *Attorney, Agent, or Firm*—Woods Fuller Shultz & Smith PC

(57) ABSTRACT

A volleyball training apparatus is disclosed that generally includes a standard assembly, a support assembly mounted on the standard assembly, a ball assembly, and a ball suspension assembly mounted on the support assembly and supporting the ball assembly. The ball assembly may be secured to the ball suspension assembly in a manner such that the ball assembly remains secured to the ball suspension assembly upon spiking of the ball assembly by a user. In some embodiments of the invention, the ball suspension assembly comprises an elongate elastic member having opposite ends attached to the ball assembly. In some embodiments, the support assembly comprises a support member having a passage therethrough, and the ball suspension assembly comprises an elongate elastic member with a portion of the elongate elastic member extending through the support member.

20 Claims, 6 Drawing Sheets

VOLLEYBALL SPIKING TRAINING SYSTEM

RELATED DATA

The subject matter of the present utility patent application has been registered with the United States Patent and Trademark Office under the disclosure document program. The request was received at the U.S. Patent and Trademark Office on Mar. 17, 2003 and was assigned the registration number 528,000.

BACKGROUND OF THE INVENTION

1. Field of the Invention

The present invention relates to volleyball training systems and more particularly pertains to a new volleyball spiking training system for permitting players to practice the act of spiking a volleyball in a highly realistic manner that provides realistic levels of resistance to striking contact with the ball, while reducing the possibly of injuries associated with spiking practice.

2. Description of the Prior Art

Apparatus for training and practicing volleyball playing and techniques are known, even apparatus for practicing spiking of the volleyball over the volleyball net. However, the known devices typically have drawbacks either in the structure or the realism of play presented to the user of the device.

For example, some devices present hard structures that are closely proximate to the ball to be stuck during the practice of spiking, which raises the possibility of injury to the player if he or she misses hitting the ball and instead hits a relatively immovable portion of the device. Some of the known devices are not highly portable or adaptable to the availability of different gym facilities, and those devices that are more portable appear to lack the sturdiness that is needed for a device that is repeatedly exposed to shock forces applied by the hands of the user to an associated volleyball. Many of the known devices are designed to release the ball when it is struck, and as a result the ball (or several balls) must be "reloaded" into the device between each hit, which can slow down the practice session significantly.

Additionally, the resistance presented to the hand of the user as the ball is stuck can injure a player if the level of resistance to movement presented by the ball is too great, but if the level of resistance to movement is too low, the realism may suffer and the strengthening of the player's arm may not occur. In either case, any significant rebound of the ball on the device back towards the arm of the player may be too great and possibly endanger the player during follow though motion.

Also, some of the known devices are not highly adjustable in the resistance that they do present to the spiking hand of the user, so that the resistance cannot be readily adjusted to the strength level of different users.

In these respects, the volleyball spiking training system according to the present invention substantially departs from the conventional concepts and designs of the prior art, and in so doing provides an apparatus primarily developed for the purpose of permitting players to practice the act of spiking a volleyball in a highly realistic manner that provides realistic levels of resistance to striking contact with the ball, while reducing the possibly of injuries associated with spiking practice.

SUMMARY OF THE INVENTION

In view of the foregoing disadvantages inherent in the known types of volleyball training systems now present in the prior art, the present invention provides a new volleyball spiking training system that can be utilized for permitting players to practice the act of spiking a volleyball in a highly realistic manner that provides realistic levels of resistance to striking contact with the ball, while reducing the possibly of injuries associated with spiking practice.

To attain this, the present invention generally comprises a volleyball training apparatus that generally includes a standard assembly, a support assembly mounted on the standard assembly, a ball assembly, and a ball suspension assembly mounted on the support assembly and supporting the ball assembly. The ball assembly may be secured to the ball suspension assembly in a manner such that the ball assembly remains secured to the ball suspension assembly upon spiking of the ball assembly by a user.

In some embodiments of the invention, the ball suspension assembly comprises an elongate elastic member having opposite ends attached to the ball assembly. In some embodiments, the support assembly comprises a support member having a passage therethrough, and the ball suspension assembly comprises an elongate elastic member with a portion of the elongate elastic member extending through the support member. As an option, the ball assembly may include a ball and a pair of support loops extending from substantially opposite locations on the ball, with each of the opposite ends of the elongate elastic member being attached to one of the support loops on the ball. As a further option, the elongate elastic member may have a plurality of sections, with at least two of the plurality of sections of the elongate elastic member having different levels of resistance to stretching relative to each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the character of the motion of the volleyball during the follow through after it has been struck by the user, which provides a more natural feel highly comparable to a free flying volleyball. This naturalism is achieved, however, without releasing the volleyball from the device, so that the ball does not have to be reloaded into the invention after each spiking contact by a user. Further, hard or immovable surfaces are kept well away from the ball and the contact zone, so that the possibility of injury from accidentally striking one of those surfaces is greatly reduced. Further, the invention permits the resistance level exhibited by the apparatus to be readily adjusted, so that the relative strength of the user can be taken into consideration for more effective practice.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
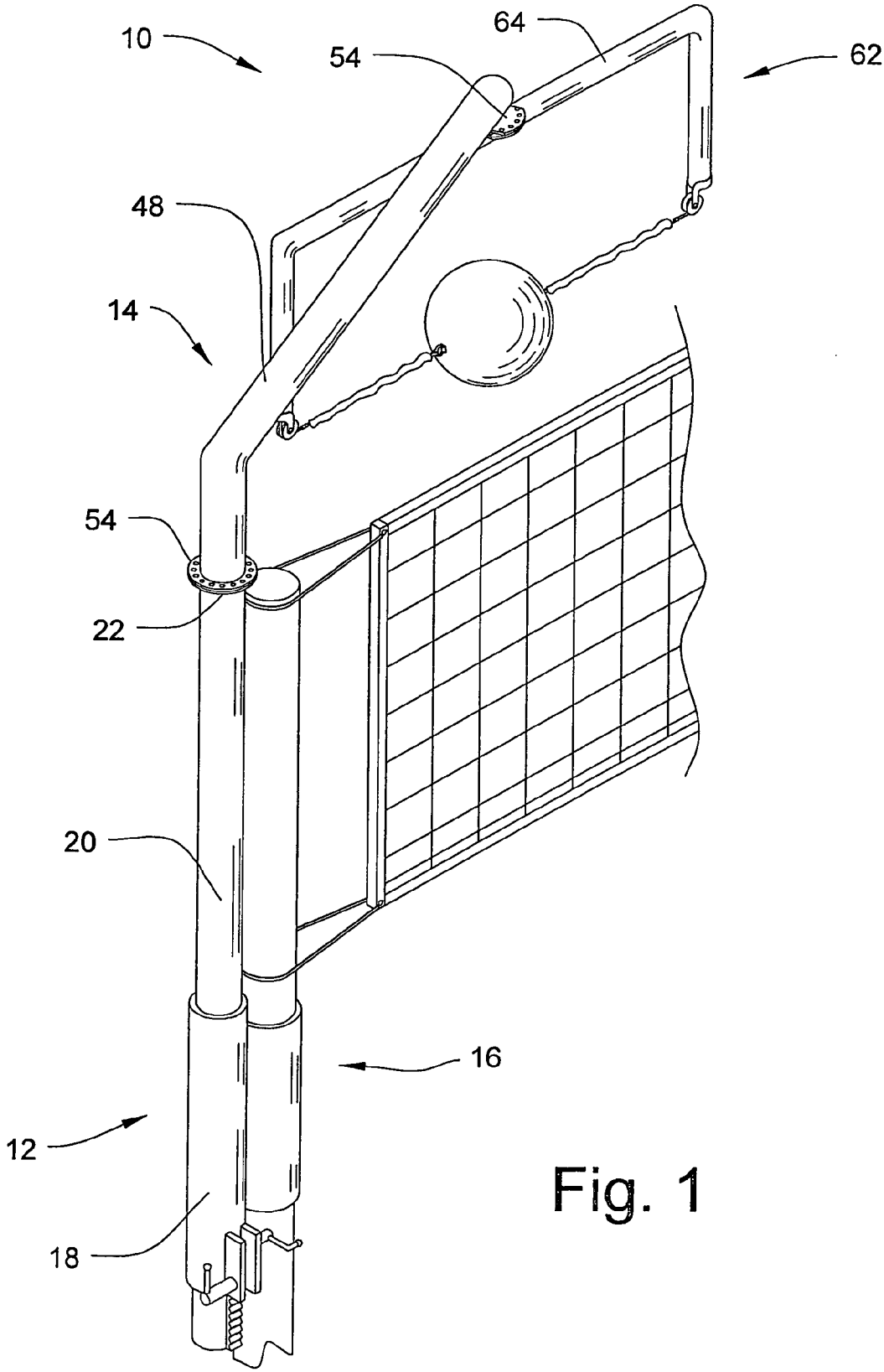
FIG. 1 is a schematic perspective view of the volleyball spiking training system according to the present invention.

With reference now to the drawings, and in particular to FIGS. 1 through 6 thereof, a new volleyball spiking training system embodying the principles and concepts of the present invention and generally designated by the reference numeral 10 will be described.

As best illustrated in FIGS. 1 through 5, the volleyball training apparatus 10 generally comprises a standard assembly 12 for positioning on a floor surface, a support assembly 62, a ball assembly 100, and a ball suspension assembly 122 (see FIG. 1).

The standard assembly 12 of the apparatus 10 of the invention comprises an upper assembly 14 and a lower assembly 16 that mat be positioned on a surface, such as a gym floor, or may be mounted on a volleyball support standard. The upper assembly 14 is removably mounted on the lower assembly 16, and the upper assembly 14 may be adjustably positioned with respect to the lower assembly 16.

Figure 2:
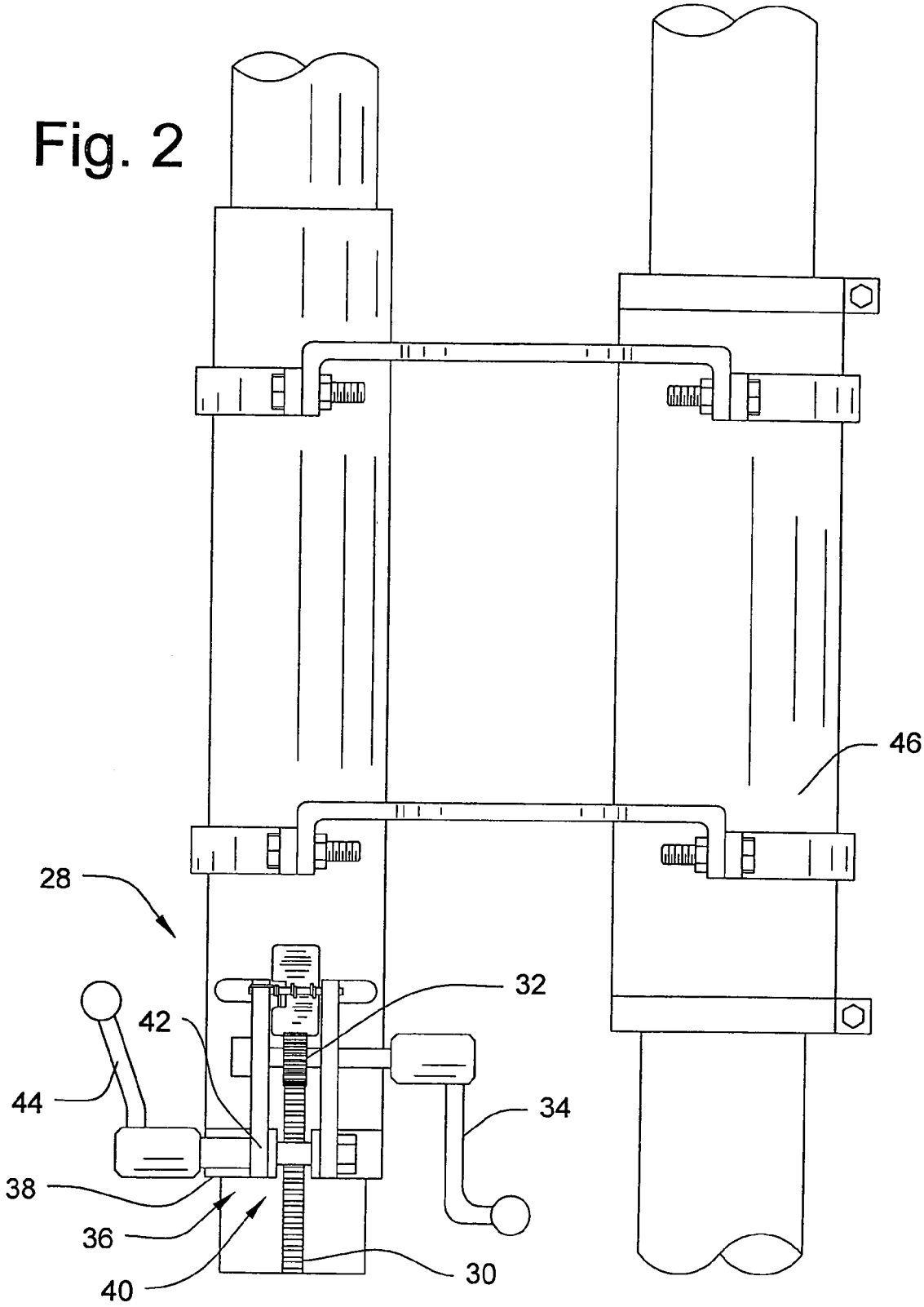
FIG. 2 is a schematic side view of a broken-away portion of the standard assembly of the spiking training system of the present invention.

The lower assembly 16 of the standard assembly 12 comprises a relatively lower post 18 and a relatively upper post 20 (see FIGS. 1 and 2). The upper post 20 may be telescopically mounted on the lower post 18 such that the upper post 20 is extendable with respect to the lower post 18. The lower post 18 may be substantially hollow such that a portion of the upper post 20 is positioned in the lower post 18. It will be apparent that the relationship between the lower post 18 and the upper post 20 may be reversed. The upper post 20 has a first mounting flange 22 mounted thereon. The first mounting flange 22 may be located toward an upper end 24 of the upper post 20. The first mounting flange 22 may be spaced from the upper end 24 of the upper post 20. The first mounting flange 22 may have a plurality of apertures 26.

The lower assembly 16 may include position adjustment structure 28 for adjusting a relative position of the upper post 20 with respect to the lower post 18. The position adjusting structure may comprise a rack 30 mounted on the lower post 18 and extending longitudinally with respect to the lower post 18. The position adjustment structure 28 may also comprise a gear 32 that is rotatably mounted on the upper post 20 and engages the rack 30 such that rotation of the gear 32 in a first direction extends the upper post 20 from the lower post 18 and rotation of the gear 32 in a second direction retracts the lower post 18 into the upper post 20. The position adjustment structure 28 may also include a crank handle 34 connected to the gear 32 such that rotation of the crank handle 34 by hand rotates the gear 32, and thus move the rack 30 on the lower post 18 with respect to the gear 32 on the upper post 20.

The lower assembly 16 may also include position locking structure 36 for selectively locking a position of the upper post 20 with respect to the lower post 18. The position locking structure 36 may comprise a collar 38 formed on the upper post 20 and extends about the lower post 18. An inner diameter of the collar 38 is adjustable in size. In one embodiment, the diameter of the collar 38 is adjustable by a collar constriction structure 40, which may comprise a camming or clenching apparatus 42, and a handle 44 for actuating the clenching apparatus 42 between a relatively looser relationship between the collar 38 and the lower post 18, and a relatively tighter relationship between the collar 38 and the lower post 18.

The lower assembly 16 of the standard assembly 12 may include an auxiliary mounting tube 46 that is mounted on the upper post 20 and that has a substantially hollow interior for receiving a volleyball net standard 2.

Figure 3:
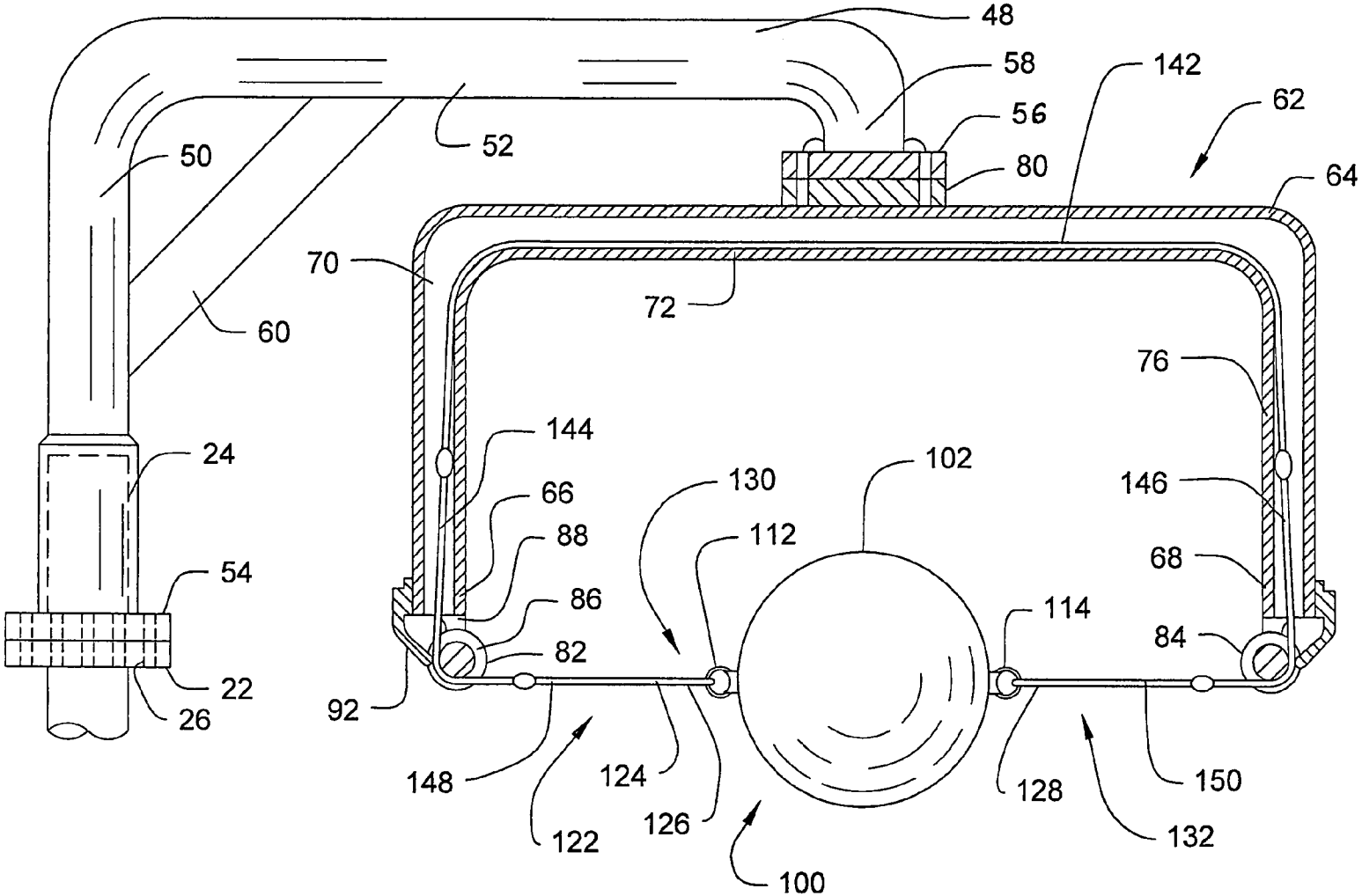
FIG. 3 is a schematic sectional view of the support assembly of the present invention, showing the suspension assembly and the ball assembly.

The upper assembly 14 of the standard assembly 12 may include a cantilever member 48 that extends in a cantilever manner from the upper post 20 of the lower assembly 16 (see FIGS. 1 and 3. The cantilever member 48 may include a substantially vertical portion 50 and a substantially horizontal portion 52. The cantilever member 48 may also have a second mounting flange 54 that is mounted on the substantially vertical portion 50 for mounting to the first mounting flange 22 when the upper end 24 of the upper post 20 of the lower assembly 16 is received in the substantially vertical portion 50 of the cantilever member 48.

A third mounting flange 56 may be mounted on the substantially horizontal portion 52 of the cantilever member 48. The third mounting flange 56 may be located toward an outboard end 58 of the substantially horizontal portion 58 of the cantilever member 48. The third mounting flange 56 may have a plurality of apertures formed therein. As an option, a reinforcing rod 60 may be extended from the substantially vertical portion 50 to the substantially horizontal portion 52 of the cantilever member 48.

The support assembly 62 is mounted on the standard assembly 12, and may include a support member 64, which is preferably pivotally mounted on the cantilever member 48 at the substantially horizontal portion 52. The support member 64 has a pair of opposite ends 66, 68. The support member 64 may have a passage 70 that extends through the member 64 between the opposite ends 66, 68. The support member 64 may also have a substantially U-shaped configuration, although other configurations may be employed. The support member 64 may include a base portion 72, and a pair of outboard portions 74, 76 that are connected to the base portion 72. The outboard portions 74, 76 may extend substantially perpendicular to the base portion 72, and may be oriented substantially parallel to each other. In the most preferred embodiments of the invention, the outboard portions 74, 76 have substantially equal lengths to each other.

A fourth mounting flange 80 may be mounted on the support member 64 for positioning adjacent to the third mounting flange 56 on the cantilevered member 48, so that the pivot position of the support assembly 62 may be selectively fixed with respect to the cantilever member 48 of the standard assembly 12. The fourth mounting flange 80 may have a plurality of apertures for aligning with the plurality of apertures of the third mounting flange 56.

The support assembly 62 may also include a guide wheel 82, 84 mounted on each of the respective opposite ends 66, 68 of the support member 64. Each of the guide wheels 66, 68 are rotatable with respect to the support member 64, and each of the guide wheels 82, 84 has a perimeter groove 86 formed therein. A pair of guide wheel support ears 88 may be mounted on each of the opposite ends 66, 68 of the support member 64. Each pair of guide wheel support ears 88 is spaced apart for receiving and mounting one of the guide wheels 82, 84. In some embodiments of the invention, a retainer member 92 is mounted on each of the ends 66, 68 of the support member 64. Each of the retainer members 92 extends from the support member 64 to a position adjacent to the groove 86 of a respective one of the guide wheels 82, 84. Each of the retainer members 92 may have a substantially T-shaped configuration with a main portion that is mounted on the support member 64 and a cross portion that is positioned in the groove 86 of the guide wheel 82, 84.

Figure 4:
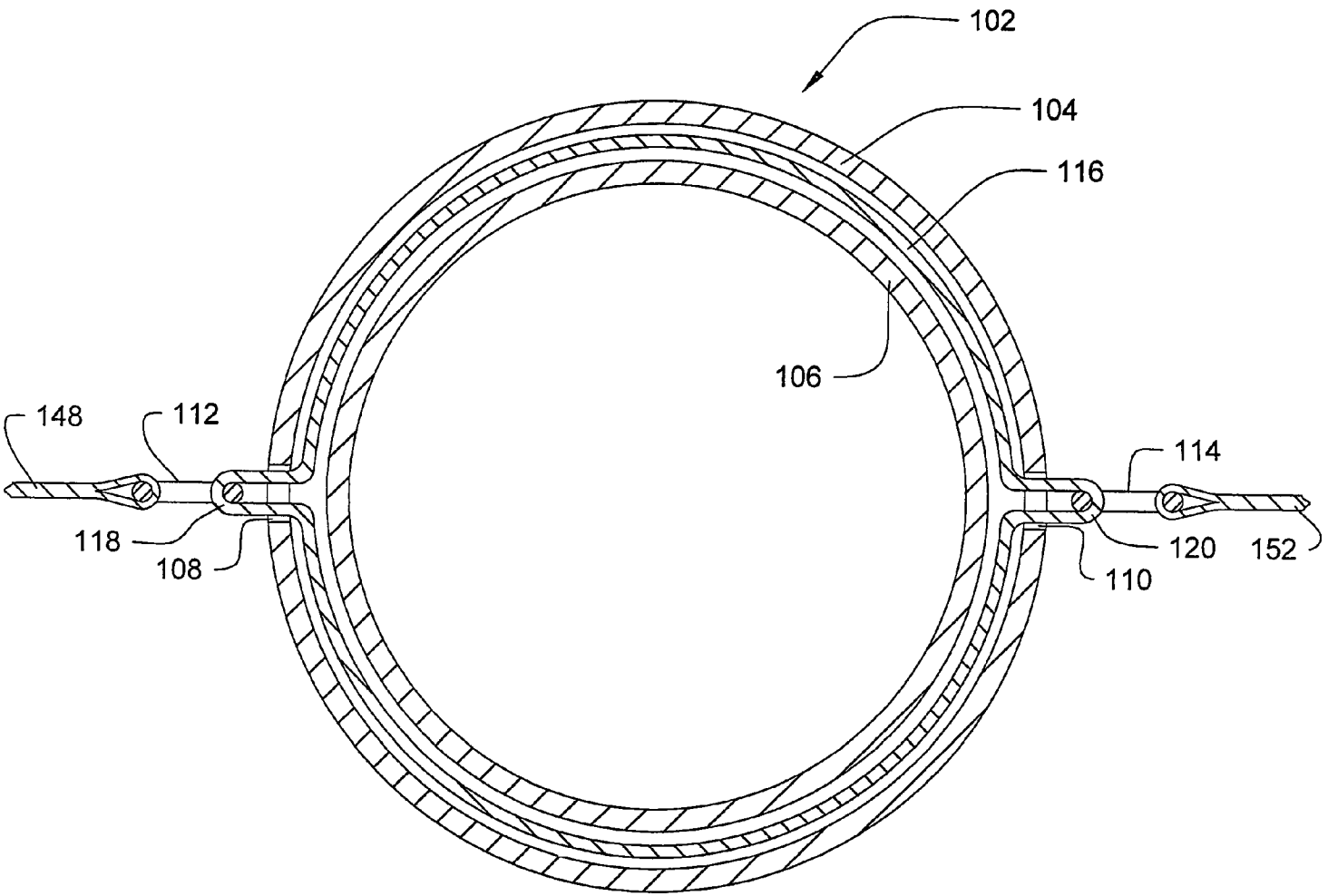
FIG. 4 is a schematic sectional view of the ball assembly of the present invention.

The ball assembly 100 of the invention may comprise a ball 102 which may include an outer layer or integument 104 and an inner layer or bladder 106 that is located inside the outer integument 104 (see FIG. 4). The inner bladder 106 of the ball 102 is substantially air tight for holding a quantity of air, and the outer integument 104 covers the inner bladder 106.

Significantly, the outer integument 104 may have has a pair of apertures 108, 110 that are formed through the outer integument 104. The pair of apertures 108, 110 is preferably located on opposite locations or sides of the outer integument 104. Optionally, additional apertures may be employed. The ball assembly may also include a pair of support loops 112, 114 mounted on the ball assembly 100 at substantially opposite locations. Preferably, the pair of support loops 112, 114 is located on diametrically opposite locations on the ball 102. Preferably, each of the support loops 112, 114 is formed of an elastomeric material, although other materials may be employed.

The ball assembly 100 may also include an anchor band 116 that extends through each of the support loops 112, 114. The anchor band 116 is preferably looped about the inner bladder 106 and may thus be positioned between the inner bladder 106 and the outer integument 104. The anchor band 116 has exterior portions 118, 120 that extend through the pair of apertures 108, 110 of the outer integument 104, and each of the exterior portions 118, 120 are extended through one of the support loops 112, 114 such that the support loops are securely attached to the structure of the ball 102 to minimize the possibility of the ball coming loose from the support loops and the ball suspension assembly 122.

The ball suspension assembly 122 is mounted on the support assembly 12 and supporting the ball assembly 100. The ball suspension assembly 122 may include an elongate elastic member 124 that has opposite ends 126, 128 that are mounted on the ball assembly 100, such as on each of the support loops 112, 114 of the ball assembly 100. The elongate elastic member 124 has opposite end portions 130, 132 that are located adjacent to the respective opposite ends 126, 128.

In one embodiment of the invention, the elongate elastic member 124 extends through the support member 64 of the support assembly 62, and the opposite end portions 130, 132 extend out of the opposite ends 66, 68 of the support member 64. In another embodiment of the invention, the elongate elastic member may comprise a pair of elongate elastic segments with each segment having opposite ends. Each of the elongate elastic segments of this embodiment has a first end that is mounted on one of the opposite ends 66, 68 of the support member 64 of the support assembly 62, and each of the elongate elastic segments has a second end that is mounted on the ball assembly 100.

In one embodiment of the invention, the elongate elastic member 124 has a plurality of sections, and at least two of the plurality of sections may have different levels of resistance (relative to each other) to stretching in a longitudinal direction. More specifically, a first type of material for a section of the elongate elastic member 124 has a relatively higher resistance to stretching than a second type of material for a section of the elongate elastic member.

In the illustrated embodiment of the invention, the elongate elastic member 124 has five sections, numbered 142, 144, 146, 148, and 150. A first section 142 of the elongate elastic member 124 may be of the first type of material and exhibit the first level of resistance to stretching. The first section 142 may be positioned on or inside the support member 64 between the ends 66, 68 thereof.

A second section 144 of the elongate elastic member 124 is positioned on and attached to a first end of the first section 142 of the elongate elastic member, and a third section 146 of the elongate elastic member is positioned on and attached to a second and opposite end of the first section 142. The second section 144 and the third section 146 of the elastic member 124 each extend through a respective end 66, 68 of the support member 64 such that the second 144 and third 146 sections are located partially inside and partially outside of the support member 64.

A fourth section 148 of the elongate elastic member 124 may be positioned between the second section 144 and the ball assembly 100 and a fifth section 150 of the member 124 may be positioned between the third section 146 and the ball assembly 100. The fourth 148 and fifth 150 sections may be located outside of the support member 64. It should be realized that the various sections of the elongate elastic member 124 may be connected together in various ways using various structures, but the most preferred means of connection are those structures that are less likely to injure the hand of a player using the invention, such as those structures that are relatively soft and/or don't have sharp edges or points.

Preferably, but not critically, at least some of the sections of the elastic member 124 are comprised of a latex (or latex substitute) material. Illustratively, the latex material of the sections may comprise a band product available under the tradename THERA-BAND from The Hygenic Corporation of Akron, Ohio. The THERA-BAND band products are available in a number of various resistance levels, which may be indicated by the color of the band, and which may permit the adjustment of the resistance level exhibited by the elongate elastic member 124 and thereby the resistance exhibited by the ball assembly to being struck by the hand of the user. Generally, he latex band material permits a greater degree of elongation by the elongate elastic member without a significant increase in the degree of resistance exhibited. The latex material of the band products has been found to be relatively easy to tie into a knot to connect to other structures, such as the support loops 112, 114 of the ball assembly 100. Other sections of the elongate elastic member 124 may comprise elastic rope elements typically referred to as "bungee cords" or "shock cords" or "tie downs" with hooks mounted on the ends.

In the illustrative embodiment of the invention, the first 142, fourth 148 and fifth 150 sections of the elongate elastic member 124 each comprise a latex (or latex substitute) band, such as the THERA-BAND bands, and the second 144 and third 146 sections of the elongate elastic member each comprise a bungee cord. This particular arrangement is useful in that the bungee cords are highly suitable for being reeved in the groove of the guide wheels 82, 84, while the latex bands provide the ability to adjust the resistance to stretching when one type of latex band is substituted for another type of latex band.

Figure 5:
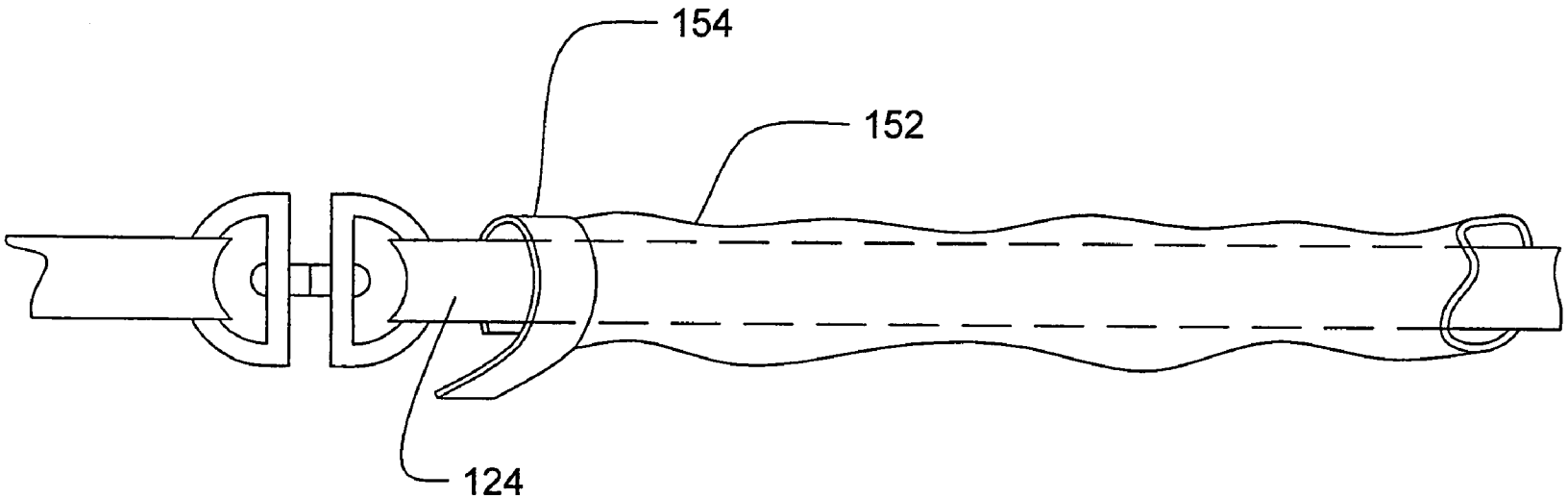
FIG. 5 is a schematic side view of a portion of the suspension assembly of the present invention.

Optionally, a sleeve 152 may be positioned over portions of the elongate elastic member 124 in order to dampen oscillations of the ball 102 (and the elongate elastic member 124) after being struck by the hand of the user, as well as providing a measure of additional protection to the hand of the user should the user miss hit the ball assembly 100 (see FIG. 5). The sleeve 152 may comprise a soft, flexible and even compressible material. The sleeve 152 may include an end collar 154 at each end of the sleeve that may be constricted to secure the position of the sleeve 152 on the elongate elastic member 124.

Figure 6:
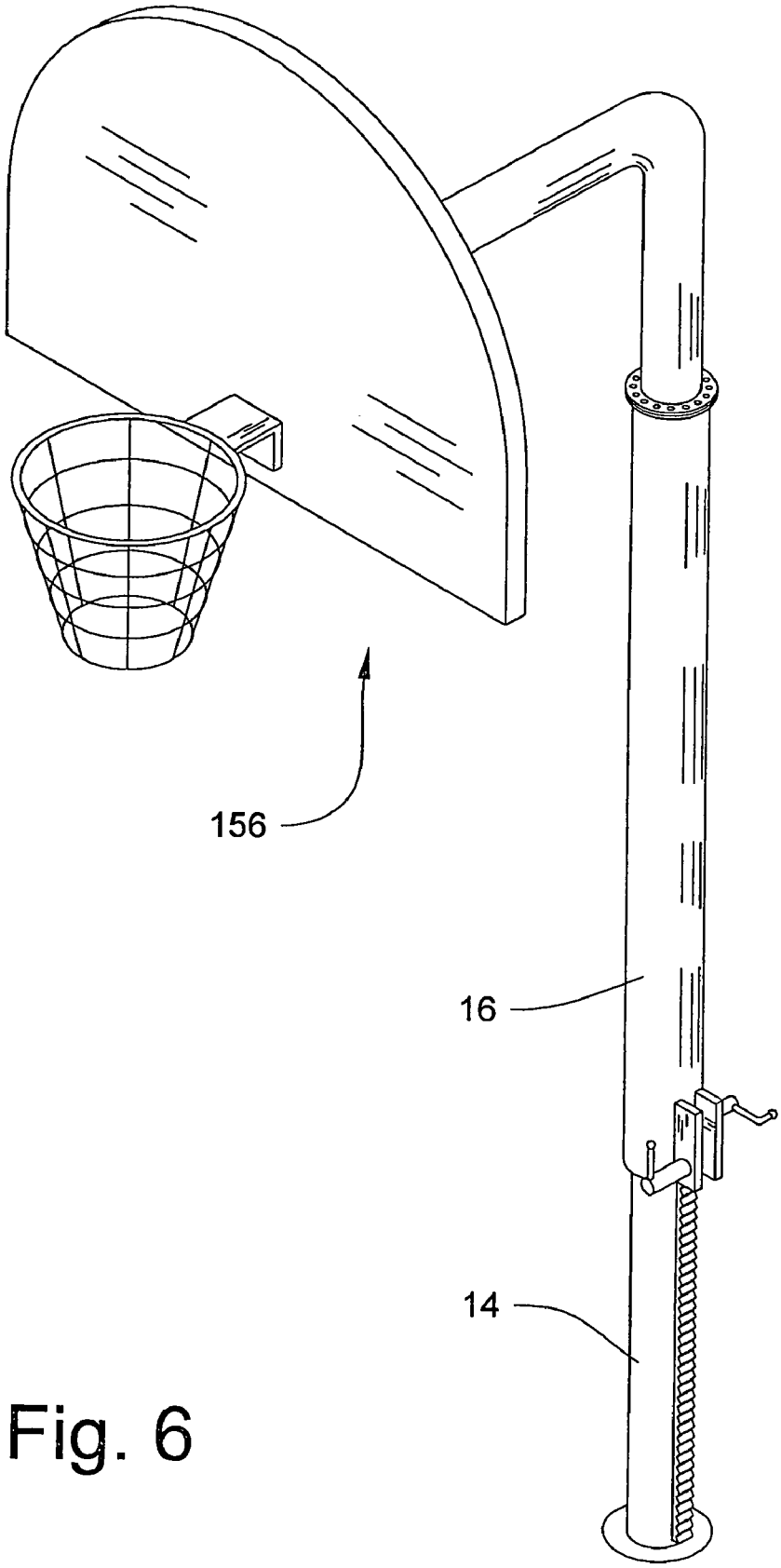
FIG. 6 is a schematic side view of the present invention with an optional basketball attachment for the standard assembly.

As a further option that enhances the versatility of the invention, the upper assembly 14 may be removed from the lower assembly 16, and a basketball hoop assembly 156 (see FIG. 6) may be mounted on the lower assembly 16 to provide a basketball hoop and backboard when the invention is not being used for volleyball training purposes. As yet a further option, the standard assembly 12 may be adapted to insert directly into a hole in a playing floor, rather than the post 18 being mounted on a volleyball net standard as show in FIGS. 1 and 2, so that the apparatus is essentially free standing. Although this optional configuration is shown in FIG. 6 with the optional basketball hoop assembly 156, it should be understood that the direct mounting of the standard assembly 12 on the floor may be employed with the upper assembly 14 of the standard assembly 12 that is shown in FIGS. 1 through 3. Further, it should also be understood that the invention may be incorporated into (or form an integral part of) a volleyball net standard such that the position adjustment assembly 28 (and possibly the position locking structure 36) form an integral part of the standard.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A volleyball training apparatus, comprising:

a standard assembly;

a support assembly mounted on the standard assembly;

a ball assembly; and a ball suspension assembly mounted on the support assembly and supporting the ball assembly, the ball assembly being secured to the ball suspension assembly in a manner such that the ball assembly remains secured to the ball suspension assembly upon spiking of the ball assembly by a user;

wherein the support assembly comprises a support member having a passage therethrough, and the ball suspension assembly comprises an elongate elastic member with a portion of the elongate elastic member extending through the support member.

2. The apparatus of claim 1 wherein the ball suspension assembly comprises an elongate elastic member having opposite ends attached to the ball assembly.

3. The apparatus of claim 2 wherein the ball assembly includes a ball and a pair of support loops extending from substantially opposite locations on the ball, each of the opposite ends of the elongate elastic member being attached to one of the support loops on the ball.

4. The apparatus of claim 1 wherein the support member has a pair of opposite ends, and the elongate elastic member extends through the support member and between the opposite ends.

5. The apparatus of claim 1 wherein the standard assembly is extendable and contractible.

6. The apparatus of claim 1 wherein the standard assembly comprises an upper assembly and a lower assembly, the upper assembly being removably mounted on the lower assembly.

7. The apparatus of claim 6 wherein the lower assembly of the standard assembly includes position adjustment means for adjusting a relative position of an upper post of the standard assembly with respect to a lower post of the standard assembly.

8. The apparatus of claim 6 wherein the lower assembly of the standard assembly includes position locking means for selectively locking a position of an upper post of the standard assembly with respect to a lower post of the standard assembly.

9. The apparatus of claim 6 wherein the standard assembly includes an auxiliary mounting tube mounted on an upper post of the standard assembly and having a substantially hollow interior for receiving a volleyball net standard.

10. The apparatus of claim 1 wherein the ball assembly comprises a ball, and a pair of support loops mounted on the ball at substantially opposite locations.

11. The apparatus of claim 10 wherein the pair of support loops are formed of an elastomeric material.

12. A volleyball training apparatus comprising:

a standard assembly;

a support assembly mounted on the standard assembly;

a ball assembly; and a ball suspension assembly mounted on the support assembly and supporting the ball assembly, the ball assembly being secured to the ball suspension assembly in a manner such that the ball assembly remains secured to the ball suspension assembly upon spiking of the ball assembly by a user;

wherein the ball suspension assembly comprises an elongate elastic member having opposite ends attached to the ball assembly; wherein the elongate elastic member has a plurality of sections, at least two of the plurality of sections of the elongate elastic member having different levels of resistance to stretching relative to each other wherein a first type of elongate elastic member having a relatively higher resistance to stretching than a second type of elongate elastic member wherein the elongate elastic member has five sections;

wherein the support assembly includes a support member, and wherein a first section of the elongate elastic member is located in the support member, the first and second sections being of a first level of resistance to stretching.

13. The apparatus of claim 12 wherein a second section of the elongate elastic member is positioned on a first end of the first section of the elongate elastic member and a third section of the elongate elastic member is positioned on a second end of the first section of the elongate elastic member, the second section and the third sections each extending through a respective opposite end of the support member such that the second and third sections are located partially inside and partially outside of the support member.

14. The apparatus of claim 13 wherein the second and third sections of the elongate elastic member are of a second level of resistance to stretching.

15. The apparatus of claim 14 wherein a fourth section of the elongate elastic member is positioned between the second section and the ball assembly and a fifth section of the elongate elastic member is positioned between the third section and the ball assembly.

16. A volleyball training apparatus comprising:

a standard assembly;

a support assembly mounted on the standard assembly;

a ball assembly; and a ball suspension assembly mounted on the support assembly and supporting the ball assembly, the ball assembly being secured to the ball suspension assembly in a manner such that the ball assembly remains secured to the ball suspension assembly upon spiking of the ball assembly by a user;

wherein the support assembly includes a support member mounted on the standard assembly and having opposite ends, and a guide wheel mounted on each of the opposite ends of the support member, each of the guide wheels being rotatable with respect to the support member, the ball suspension assembly comprising an elongate elastic member riding on the guide wheels.

17. The apparatus of claim 16 wherein the elongate elastic member has a plurality of sections, at least two of the plurality of sections of the elongate elastic member having different levels of resistance to stretching relative to each other.

18. The apparatus of claim 17 wherein a first type of elongate elastic member having a relatively higher resistance to stretching than a second type of elongate elastic member.

19. The apparatus of claim 17 wherein the elongate elastic member has five sections.

20. A volleyball training apparatus comprising:

a standard assembly;

a support assembly mounted on the standard assembly;

a ball assembly; and a ball suspension assembly mounted on the support assembly and supporting the ball assembly, the ball assembly being secured to the ball suspension assembly in a manner such that the ball assembly remains secured to the ball suspension assembly upon spiking of the ball assembly by a user;

wherein the ball assembly comprises a ball, and a pair of support loops mounted on the ball at substantially opposite locations;

wherein the ball comprises an outer integument and an inner bladder located inside the outer integument, and the ball apparatus includes an anchor band extending through each of the support loops, the anchor band being looped about the inner bladder and being positioned between the inner bladder and the outer integument.

* * * * *